US011730323B2

(12) United States Patent
Gui

(10) Patent No.: US 11,730,323 B2
(45) Date of Patent: Aug. 22, 2023

(54) INTELLIGENT HAND CLEANER

(71) Applicant: Linguo Gui, Jiujiang (CN)

(72) Inventor: Linguo Gui, Jiujiang (CN)

( * ) Notice: Subject to any disclaimer, the term of this patent is extended or adjusted under 35 U.S.C. 154(b) by 0 days.

(21) Appl. No.: 17/876,586

(22) Filed: Jul. 29, 2022

(65) Prior Publication Data

US 2022/0361720 A1 Nov. 17, 2022

(30) Foreign Application Priority Data

Jul. 18, 2022 (CN) ..... 202221844687.3

(51) Int. Cl.
*A47K 5/12* (2006.01)

(52) U.S. Cl.
CPC ..... *A47K 5/1217* (2013.01); *A47K 5/1207* (2013.01)

(58) Field of Classification Search
CPC ..... A47K 5/1217; A47K 5/127
USPC ..... 222/111, 173, 180, 181.1, 181, 2, 181.3, 222/184, 185.1, 52, 63
See application file for complete search history.

(56) References Cited

U.S. PATENT DOCUMENTS 8,770,447 B2 * 7/2014 Marshall ..... B67D 7/36 222/61
10,098,510 B2 * 10/2018 Buckalter ..... A47K 5/1211
11,272,815 B2 * 3/2022 Rospierski ..... A47K 5/1217
2004/0226962 A1 * 11/2004 Mazursky ..... A47K 5/1217 222/64
2009/0095774 A1 * 4/2009 Domoy ..... A45D 40/26 222/212
2009/0140004 A1 * 6/2009 Scorgie ..... A47K 5/1217 222/638
2010/0051640 A1 * 3/2010 Chen ..... A47K 5/1209 222/321.9
2012/0085780 A1 * 4/2012 Landauer ..... A47K 5/12 222/105
2014/0158714 A1 * 6/2014 Snodgrass ..... A47K 5/1217 222/183
2015/0173567 A1 * 6/2015 Buckalter ..... B05B 12/122 222/173
2022/0007898 A1 * 1/2022 Affan ..... A47K 5/1217
2022/0322890 A1 * 10/2022 Bijari ..... B67D 1/0004
2023/0114020 A1 * 4/2023 Butler ..... B05B 11/0038 222/325

* cited by examiner

*Primary Examiner* — Lien M Ngo
(74) *Attorney, Agent, or Firm* — Jose Cherson Weissbrot

(57) ABSTRACT

The present disclosure discloses an intelligent hand cleaner, including a mounting seat, a container, and a pressing pump; the pressing pump has a liquid storage cavity and a pressing head; the mounting seat is provided with a first liquid outlet hole; the pressing head is provided with a second liquid outlet hole; a Printed Circuit Board (PCB), a driving assembly, a battery, and a sensor are also arranged in the mounting cavity; a connector is arranged on the container; a connecting port is arranged on the mounting seat; a first positioning clamping slot is formed in the connecting port; and the connector is provided with a first positioning clamping bulge matched with the first positioning clamping slot.

9 Claims, 8 Drawing Sheets

INTELLIGENT HAND CLEANER

TECHNICAL FIELD

The present disclosure relates to an intelligent hand cleaner.

BACKGROUND

The statements here only provide the background information related to the present disclosure, and do not necessarily constitute the prior art.

With the advancement of science and technology, there have been now intelligent hand cleaners on the market that can dispense disinfectant (or hand sanitizer) without manual pressing, which can effectively cut off the spread of diseases. However, the existing intelligent hand cleaners still have some deficiencies. For example, the existing smart hand cleaners are inconvenient to assemble and disassemble, and it is troublesome for a user to replace internal hand sanitizer.

Therefore, it is necessary to study a new technical solution to solve the above problems.

SUMMARY

In order to solve the above-mentioned defects and deficiencies in the prior art, the present disclosure provides an intelligent hand cleaner. By means of designing an intelligent hand cleaner, a driving assembly is triggered by a sensor, thus pressing a pump body to dispense liquid; therefore, liquid can be dispensed without pressing a pressing head of the pump body, which further improves the use convenience; meanwhile, the probability that a user touches the cleaner with hands is reduced, which is favorable for preventing the spread of diseases; and in addition, by means of assembling of a positioning clamping bulge and a positioning clamping slot, the intelligent hand cleaner has the advantages of convenience of assembling and disassembling and easy manufacturing.

In order to achieve the above-mentioned objective, the present disclosure adopts the following technical solution:

An intelligent hand cleaner includes a mounting seat provided with a mounting cavity, a container provided with a liquid containing cavity, and a pressing pump; the pressing pump is provided with a liquid storage cavity and a pressing head; the liquid storage cavity is provided with a liquid inlet communicated with the liquid containing cavity;

a first liquid outlet hole is formed in the mounting seat; the pressing head is provided with a second liquid outlet hole communicated with the liquid storage cavity; the second liquid outlet hole is communicated with the first liquid outlet hole; the first liquid outlet hole is located on a lower side surface of the mounting seat;

a Printed Circuit Board (PCB), a driving assembly for driving the pressing head to be up pressed, a battery, and a sensor are further arranged in the mounting cavity; the driving assembly, the battery, and the sensor are all electrically connected to the PCB; the sensor is located on a front side of the first liquid outlet hole;

a connector is arranged on the container; a connecting port matched with the connector is arranged on the mounting seat; a transverse "L"-shaped first positioning clamping slot is formed in the connecting port; and a first positioning clamping bulge matched with the first positioning clamping slot is arranged on the connector.

In some embodiments, the intelligent hand cleaner includes a decorative outer cover which is detachably mounted on an outer side of the container;

a lower side of the decorative outer cover is provided with a second positioning clamping bulge; and a transverse "L"-shaped second positioning clamping slot matched with the second positioning clamping bulge is formed in the mounting seat.

In some embodiments, the container is transparent.

In some embodiments, the mounting seat is detachably connected with a wall-mounted member; a first fastener is arranged on the wall-mounted member; and a second fastener matched with the first fastener is arranged on the mounting seat.

In some embodiments, a support is detachably arranged on the mounting seat; a third fastener is arranged on the support; and a fourth fastener matched with the third fastener is arranged on the mounting seat.

In some embodiments, the support includes a connecting arm, and a round supporting disk arranged at a lower end of the connecting arm; and during mounting, the supporting disk is located below the first liquid outlet hole.

In some embodiments, a lower side surface of the supporting disk is provided with a rubber pad.

In some embodiments, a "V"-shaped hollow slot is formed in the mounting seat; and a decorative part matched with the hollow slot is arranged on the hollow slot.

In some embodiments, the PCB is electrically connected with a charging port for charging a battery and protrudes on an outer side of the mounting seat; a charging clearance is reserved between the wall-mounted member and the mounting seat;

the charging port is arranged in the charging clearance.

Compared with the prior art, the present disclosure has obvious advantages and beneficial effects. Specifically, according to the above-mentioned technical solutions, by means of designing an intelligent hand cleaner, a driving assembly is triggered by a sensor, thus pressing a pump body to dispense liquid; therefore, liquid can be dispensed without pressing a pressing head of the pump body, which further improves the use convenience; meanwhile, the probability that a user touches the cleaner with hands is reduced, which is favorable for preventing the spread of diseases; and in addition, by means of assembling of a positioning clamping bulge and a positioning clamping slot, the intelligent hand cleaner has the advantages of convenience of assembling and disassembling and easy manufacturing.

Second, the cleaner of the present disclosure is selectively used with a wall-mounted member or support, so that the cleaner can be applicable to various use environments, is more suitable for being selected by customers, has higher practicability, and has a wide market prospect.

In order to describe the structural features and effects of the present disclosure more clearly, the present disclosure is described in detail below in combination with the accompanying drawings and specific embodiments.

Figure 1:
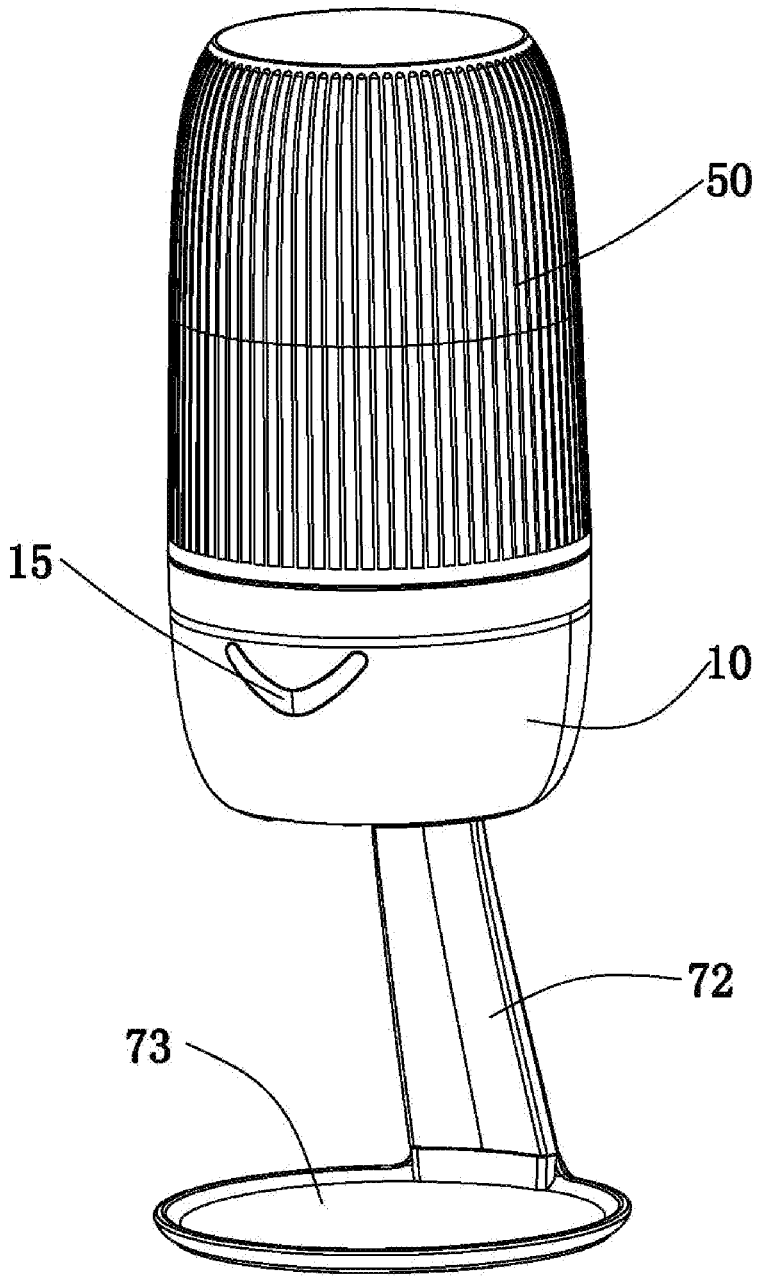
FIG. 1 is a schematic three-dimensional diagram of an embodiment of the present disclosure.

Reference signs in the drawings:

10: mounting seat; 101: first liquid outlet hole; 11: connecting port; 111: first positioning clamping slot; 112: stop convex ring; 12: second positioning clamping slot; 13: second fastener; 14: fourth fastener; 15: decorative part; 20: container; 21: connector; 211: first positioning clamping bulge; 30: pressing pump; 301: second liquid outlet hole; 31: liquid storage cavity; 32: pressing head; 40: PCB; 41: driving assembly; 411: push-up part; 42: battery; 43: sensor; 50: decorative outer cover; 501: second positioning clamping bulge; 60: wall-mounted member; 61: first fastener; 62: charging clearance; 70: support; 71: third fastener; 72: connecting arm; 73: supporting disk; 74: rubber pad.

DETAILED DESCRIPTION OF THE EMBODIMENTS

The technical solutions in the embodiments of the present disclosure will be clearly and completely described below in conjunction with the accompanying drawings. Apparently, the described embodiments are only preferred embodiments of the present disclosure.

It should be noted that when an element is referred to as being "fixed" to another element, it can be directly on the other element or an intermediate element may also exist. When an element is considered to be "connected" to another element, it can be directly connected to the other element or an intermediate element may be present at the same time. The terms "perpendicular", "horizontal", "left", "right" and similar expressions used herein are for illustrative purposes only, and are not meant to be the only implementation modes.

Unless otherwise defined, all technical and scientific terms used herein are the same as meanings of general understandings of those skilled in the art of the present disclosure. The terms used in the description of the present disclosure herein are merely to describe the specific implementation modes, not intended to limit the present disclosure. The term "and/or" used herein includes any and all combinations of one or more related listed items.

Figure 2:
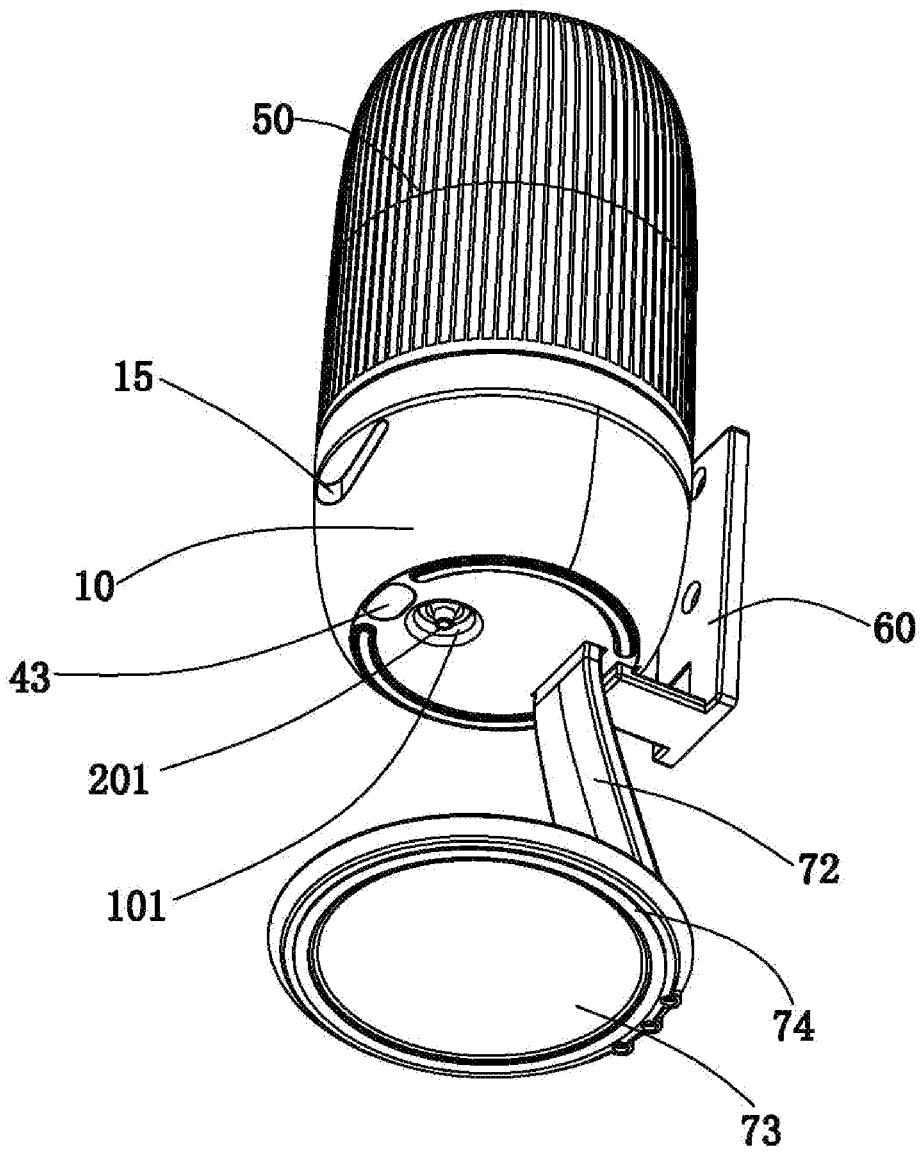
FIG. 2 is a schematic three-dimensional diagram of an embodiment of the present disclosure in another angle.
Figure 3:
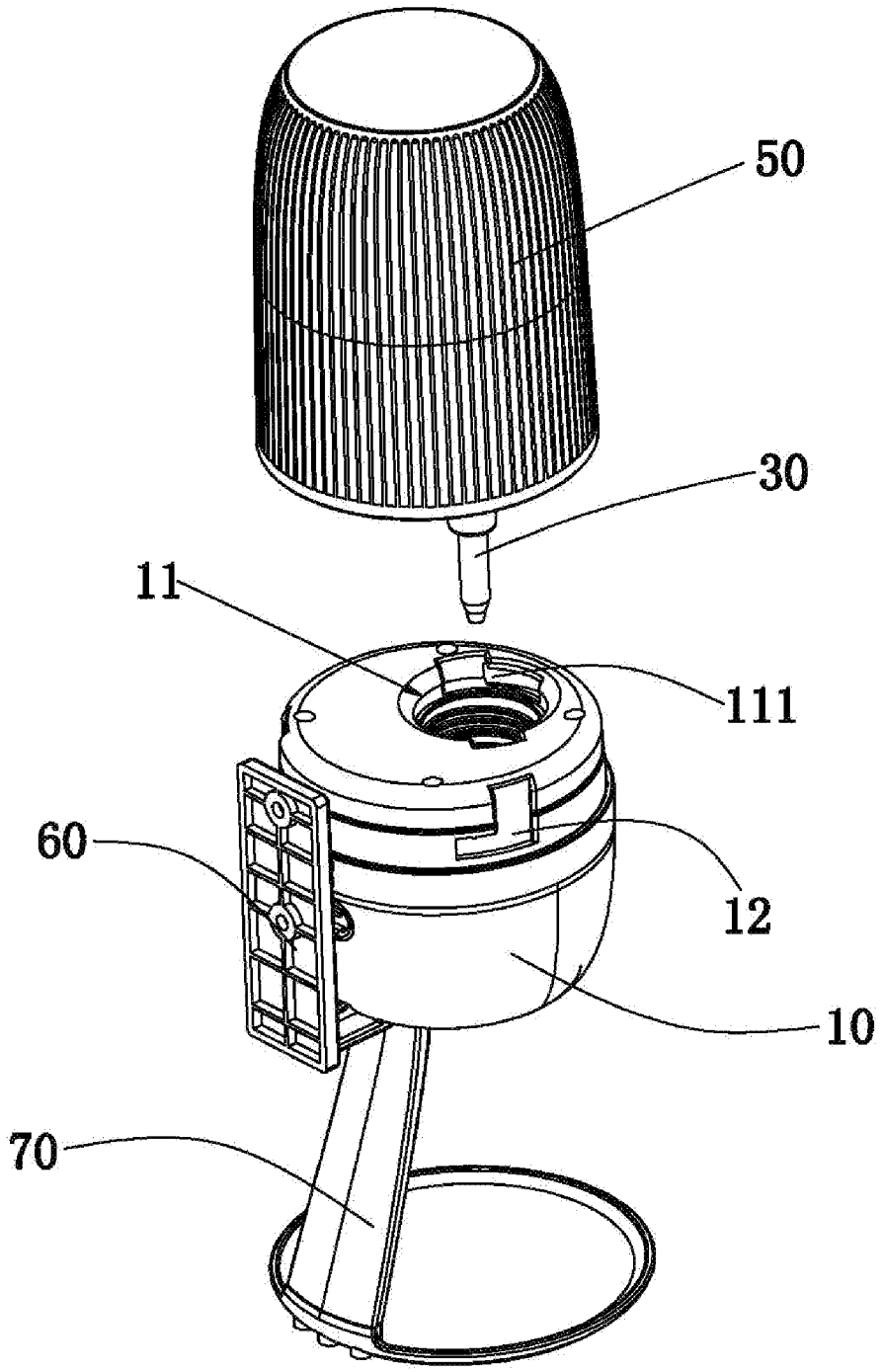
FIG. 3 is a first schematic exploded diagram of an embodiment of the present disclosure.
Figure 4:
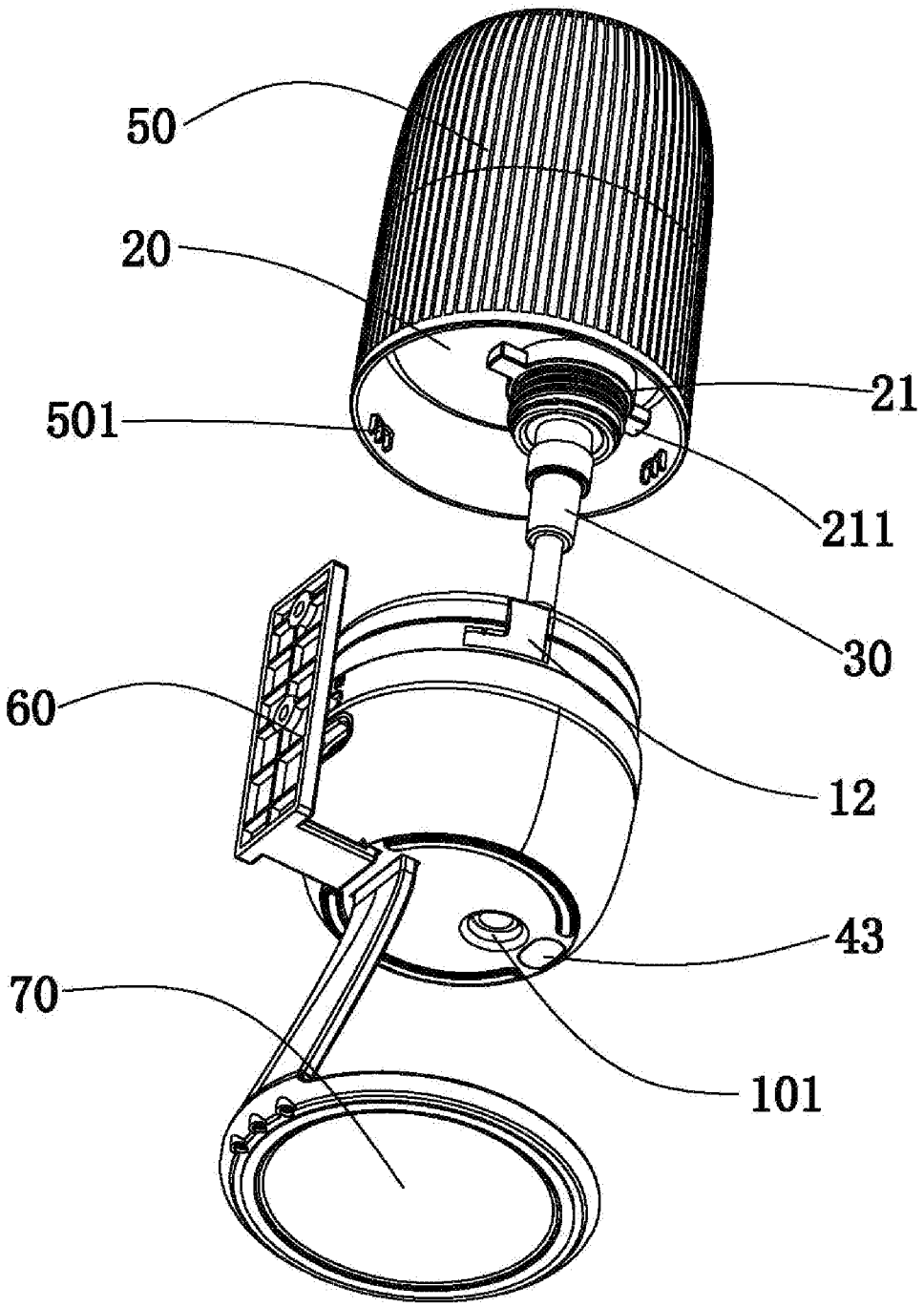
FIG. 4 is a second schematic exploded diagram of an embodiment of the present disclosure.
Figure 5:
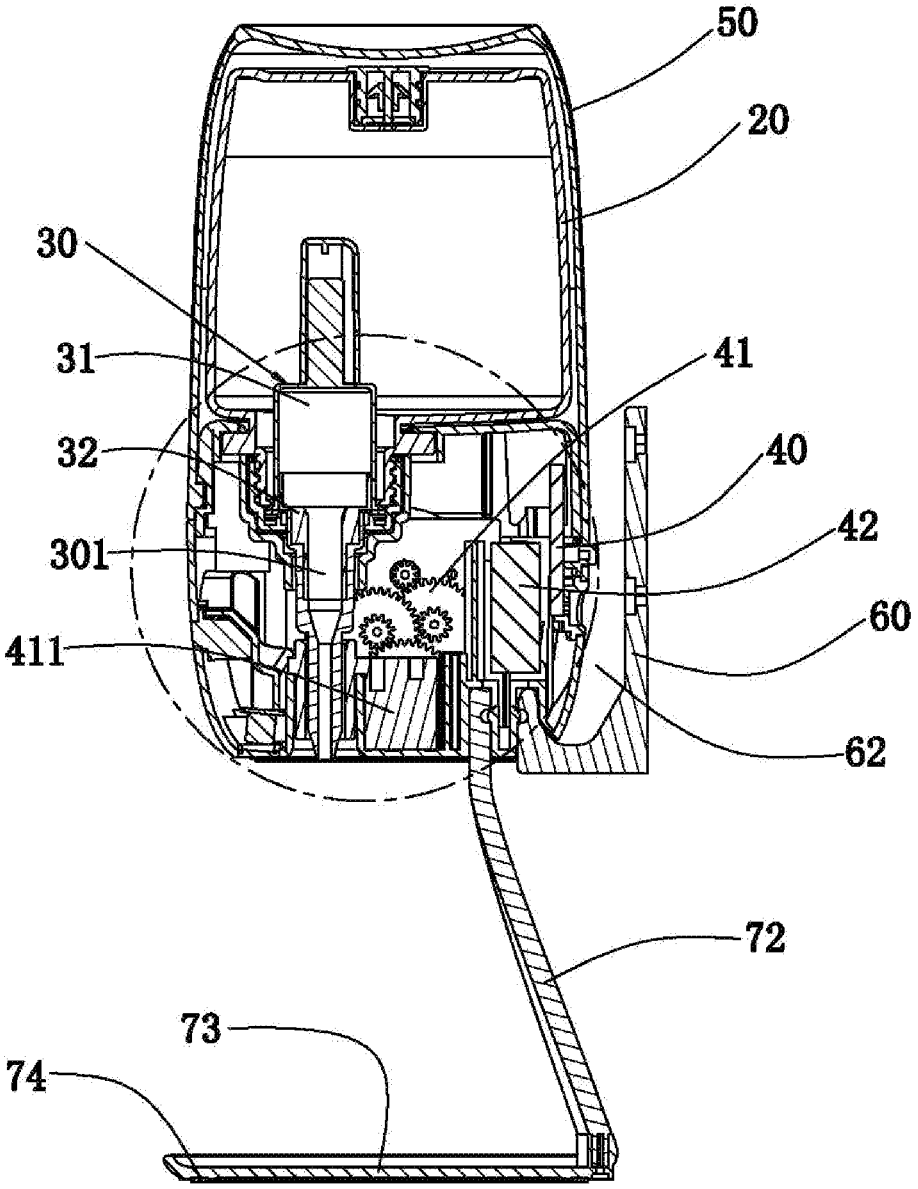
FIG. 5 is a schematic sectional diagram of an embodiment of the present disclosure.
Figure 6:
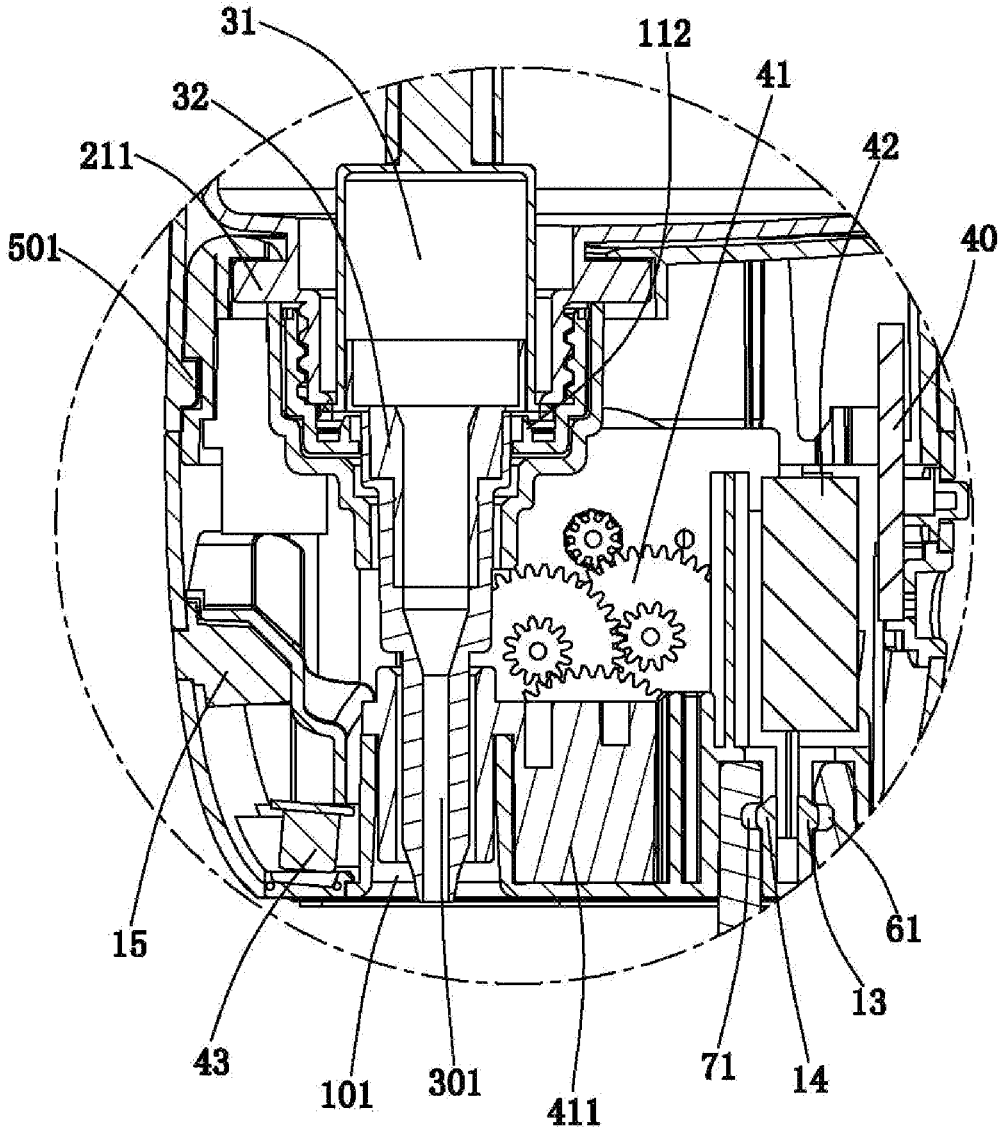
FIG. 6 is a partially enlarged diagram of FIG. 5.
Figure 7:
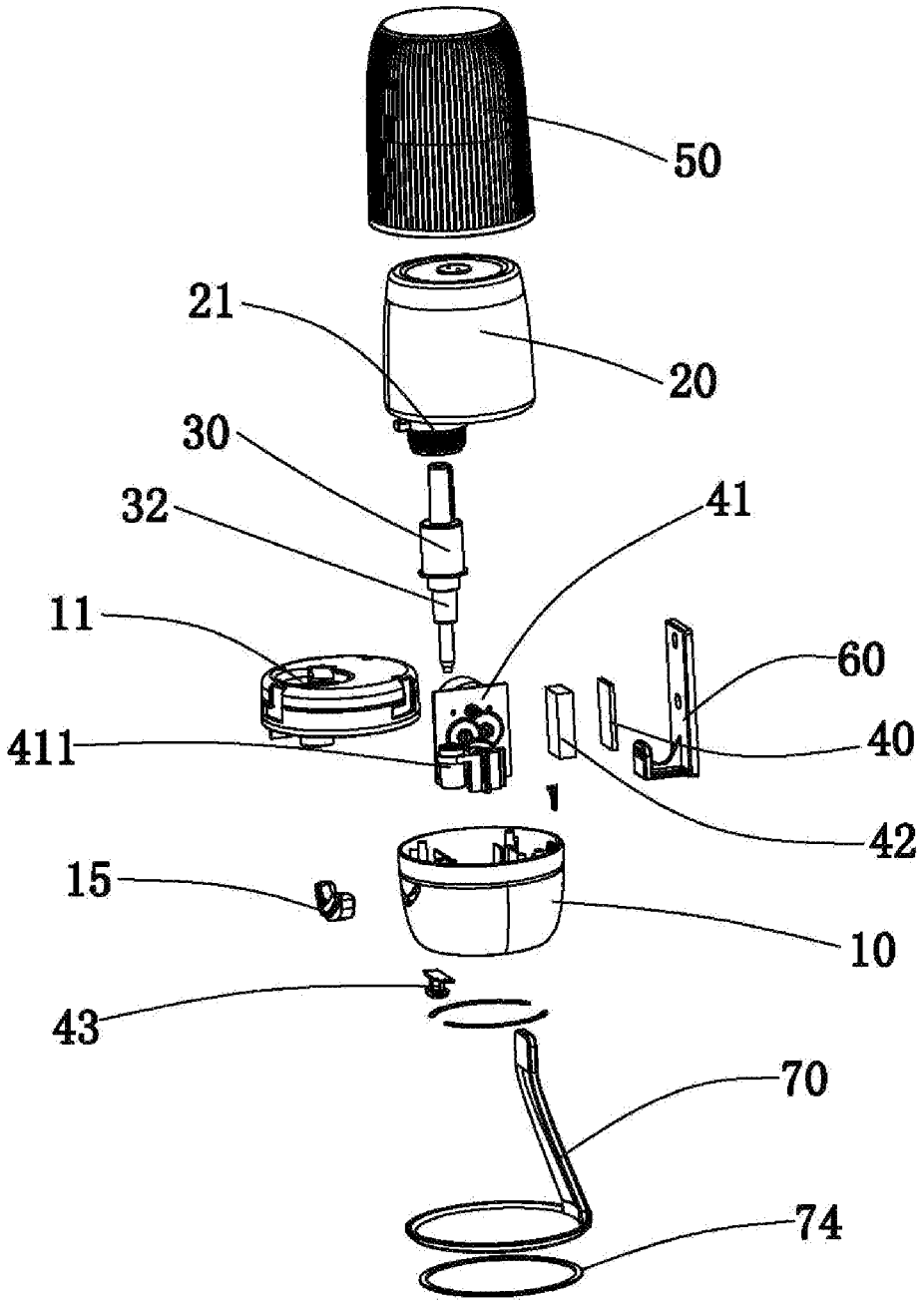
FIG. 7 is a third schematic exploded diagram of an embodiment of the present disclosure.
Figure 8:
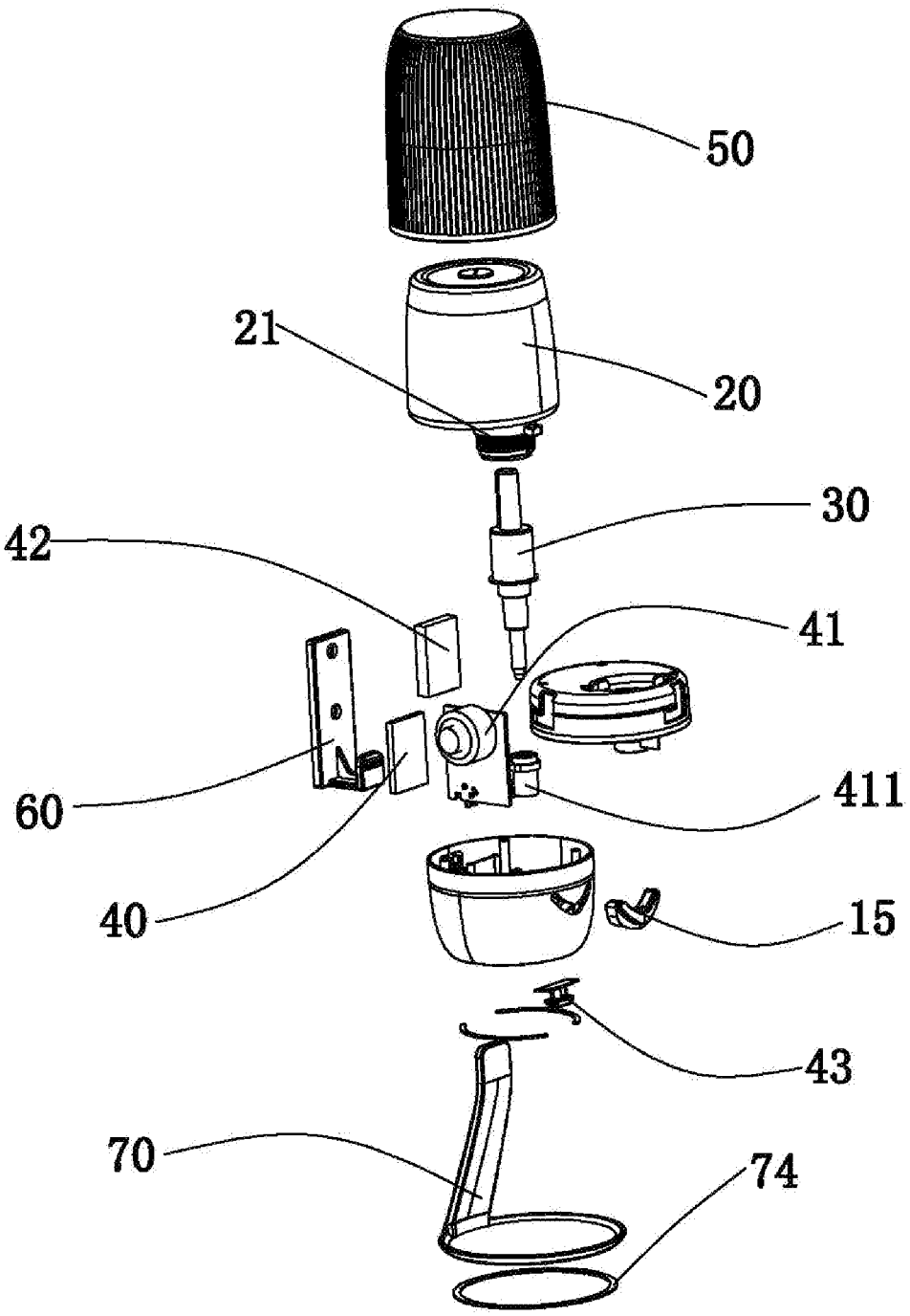
FIG. 8 is a fourth schematic exploded diagram of an embodiment of the present disclosure.

Referring to FIG. 1 to FIG. 8, an intelligent hand cleaner in an embodiment of the present disclosure includes a mounting seat 10 provided with a mounting cavity, a container 20 provided with a liquid containing cavity, and a pressing pump 30. The pressing pump 30 is provided with a liquid storage cavity 31 and a pressing head 32. The liquid storage cavity 31 is provided with a liquid inlet communicated with the liquid containing cavity.

A first liquid outlet hole 101 is formed in the mounting seat 10; the pressing head 32 is provided with a second liquid outlet hole 301 communicated with the liquid storage cavity 31; the second liquid outlet hole 301 is communicated with the first liquid outlet hole 101; and the first liquid outlet hole 101 is located on a lower side surface of the mounting seat 10.

A PCB 40, a driving assembly 41 for driving the pressing head 32 to perform pressing, a battery 42, and a sensor 43 are further arranged in the mounting cavity; the driving assembly 41, the battery 42, and the sensor 43 are all electrically connected to the PCB 40; and the sensor 43 is located on a front side of the first liquid outlet hole 101.

A connector 21 is arranged on the container 20; a connecting port 11 matched with the connector 21 is arranged on the mounting seat 10; a transverse "L"-shaped first positioning clamping slot 111 is formed in the connecting port 11; and a first positioning clamping bulge 211 matched with the first positioning clamping slot 111 is arranged on the connector 21.

As such, when a user reaches the lower side surface of the mounting seat 10 with a hand, the sensor 43 can sense a corresponding signal and transmit the corresponding signal to the PCB 40. The PCB 40 controls the driving assembly 41 to up press the pressing head 32 of the pressing pump 30, thus cleaning liquid in the liquid containing cavity flows out from the first liquid outlet hole 101. After up pressing is completed, a motor rotates anticlockwise, and the pressing head 32 is reset. Meanwhile, the first positioning clamping bulge 211 and the first positioning clamping slot 111 are correspondingly arranged on the container 20 and the mounting seat 10 to achieve a detachable design. The intelligent hand cleaner has the advantages of easy manufacturing and convenience of assembling and disassembling, and it is convenient for a user to refill the container 20. During application, the pressing pump 30 is located in the connector 21, protrudes on a lower side of the connector 21 in a pressing manner and extends into the mounting seat 10. During specific application, the liquid inlet and the second liquid outlet hole 301 are both provided with a check valve, and are also provided with a reset spring for resetting the pressing head. This is the existing structural design of the pressing pump 30, and will not be repeatedly described. Meanwhile, the sensor 43 may be an infrared sensor.

Preferably, the connector 21 is further provided with an external connecting thread, and the connecting port 11 is provided with an internal connecting thread matched with the external connecting thread, so that the connection stability is further improved. A stop convex ring 112 for limiting the pressing pump 30 is also arranged in the connecting port 11.

Further, the intelligent hand cleaner further includes a decorative outer cover 50 which is detachably mounted on an outer side of the container 20.

A lower side of the decorative outer cover 50 is provided with a second positioning clamping bulge 501; and a transverse "L"-shaped second positioning clamping slot 12 matched with the second positioning clamping bulge 501 is formed in the mounting seat 10. As such, the second positioning clamping bulge 501 and the second positioning clamping slot 12 are correspondingly adopted on the decorative outer cover 50 and the mounting seat 10, which also further facilitate the mounting and removal operations of the decorative outer cover 50.

Preferably, the container 20 may be transparent. For example, the container 20 may be made of transparent or semitransparent plastic (such as PC, PE, PP, and PVC). As such, after the decorative outer cover 50 is removed, a user can observe a stock of cleaning liquid in the container 20 to determine whether to add cleaning liquid.

Further, the mounting seat 10 is detachably connected with a wall-mounted member 60; a first fastener 61 is arranged on the wall-mounted member 60; and a second fastener 13 matched with the first fastener 61 is arranged on the mounting seat 10.

Further, a charging clearance 62 is reserved between the wall-mounted member 60 and the mounting seat 10; the PCB is electrically connected with a charging port for charging the battery 42; and the charging port is located in the charging clearance 62.

Meanwhile, a support 70 is detachably arranged on the mounting seat 10; a third fastener 71 is arranged on the support 70; and a fourth fastener 14 matched with the third fastener 71 is arranged on the mounting seat 10. Specifically, the support 70 includes a connecting arm 72, and a round supporting disk 73 arranged at a lower end of the connecting arm 72; and during mounting, the supporting disk 73 is located below the first liquid outlet hole 101. Meanwhile, an outer edge of the supporting disk 73 upwards extends to form an enclosed dam, thus forming an enclosed cavity for catching redundant cleaning liquid. When the cleaner is used improperly, the cleaning liquid will fall into the enclosed cavity to avoid direct dripping on the ground or a tabletop.

As such, a user can select the wall-mounted member 60 or the support 70 according to a use environment and use it with the cleaner, which adds an application scenario of the cleaner and more comprehensively considers use demands of different users. Preferably, a lower side surface of the supporting disk 73 is provided with a rubber pad 74. Thus, when the cleaner and the support 70 are used cooperatively, since a frictional coefficient between a foot pad and the tabletop is larger, the cleaner is placed more stably.

Further, a "V"-shaped hollow slot is formed in the mounting seat 10, and is like a smiling face. A decorative part 15 matched with the hollow slot is arranged on the hollow slot, which further improves the sense of beauty of a product. The decorative part 15 may be a luminous part containing fluorescent powder.

Further, the driving assembly 41 includes a motor, a gear set and a push-up part 411; the motor is in driving connection with the gear set; and an eccentric column is arranged on the gear set. The eccentric column is connected to the push-up part 411, so that the push-up part 411 does a reciprocating motion up and down.

The key point of design of the present disclosure is that by means of designing an intelligent hand cleaner, a driving assembly is triggered by a sensor, thus pressing a pump body to dispense liquid; therefore, liquid can be dispensed without pressing a pressing head of the pump body, which further improves the use convenience; meanwhile, the probability that a user touches the cleaner with hands is reduced, which is favorable for preventing the spread of diseases; and in addition, by means of assembling of a positioning clamping bulge and a positioning clamping slot, the intelligent hand cleaner has the advantages of convenience of assembling and disassembling and easy manufacturing.

Second, the cleaner of the present disclosure is selectively used with a wall-mounted member or support, so that the cleaner can be applicable to various use environments, is more suitable for being selected by customers, has higher practicability, and has a wide market prospect.

The above descriptions are only preferred embodiments of the present disclosure, and do not limit the technical scope of the present disclosure. Therefore, any minor changes, equivalent changes and modifications made to the above embodiments according to the technical essence of the present disclosure still fall within the scope of the technical solutions of the present disclosure.

What is claimed is:

1. An intelligent hand cleaner, comprising a mounting seat provided with a mounting cavity, a container provided with a liquid containing cavity, and a pressing pump, wherein the pressing pump is provided with a liquid storage cavity and a pressing head; the liquid storage cavity is provided with a liquid inlet communicated with the liquid containing cavity;

a first liquid outlet hole is formed in the mounting seat; the pressing head is provided with a second liquid outlet hole communicated with the liquid storage cavity; the second liquid outlet hole is communicated with the first liquid outlet hole; the first liquid outlet hole is located on a lower side surface of the mounting seat;

a Printed Circuit Board (PCB), a driving assembly for driving the pressing head to be up pressed, a battery, and a sensor are further arranged in the mounting cavity; the driving assembly, the battery, and the sensor are all electrically connected to the PCB; the sensor is located on a front side of the first liquid outlet hole;

a connector is arranged on the container; a connecting port matched with the connector is arranged on the mounting seat; a transverse "L"-shaped first positioning clamping slot is formed in the connecting port; and a first positioning clamping bulge matched with the first positioning clamping slot is arranged on the connector.

2. The intelligent hand cleaner according to claim 1, comprising a decorative outer cover which is detachably mounted on an outer side of the container, wherein a lower side of the decorative outer cover is provided with a second positioning clamping bulge; and a transverse "L"-shaped second positioning clamping slot matched with the second positioning clamping bulge is formed in the mounting seat.

3. The intelligent hand cleaner according to claim 2, wherein the container is transparent.

4. The intelligent hand cleaner according to claim 3, wherein the mounting seat is detachably connected with a wall-mounted member; a first fastener is arranged on the wall-mounted member; and a second fastener matched with the first fastener is arranged on the mounting seat.

5. The intelligent hand cleaner according to claim 3, wherein a support is detachably arranged on the mounting seat; a third fastener is arranged on the support; and a fourth fastener matched with the third fastener is arranged on the mounting seat.

6. The intelligent hand cleaner according to claim 5, wherein the support comprises a connecting arm, and a round supporting disk arranged at a lower end of the connecting arm; and during mounting, the supporting disk is located below the first liquid outlet hole.

7. The intelligent hand cleaner according to claim 6, wherein a lower side surface of the supporting disk is provided with a rubber pad.

8. The intelligent hand cleaner according to claim 1, wherein a "V"-shaped hollow slot is formed in the mounting seat; and a decorative part matched with the hollow slot is arranged on the hollow slot.

9. The intelligent hand cleaner according to claim 4, wherein the PCB is electrically connected with a charging port for charging a battery and protrudes on an outer side of the mounting seat; a charging clearance is reserved between the wall-mounted member and the mounting seat;

the charging port is arranged in the charging clearance.

* * * * *